US012510292B2

(12) United States Patent
Gluck Griswold et al.

(10) Patent No.: US 12,510,292 B2
(45) Date of Patent: Dec. 30, 2025

(54) CAN RACK SYSTEM WITH OPENINGS DIMENSIONED TO PROTECT THE CAN RACK SYSTEM

(71) Applicants: BSH Home Appliances Corporation, Irvine, CA (US); BSH Hausgeräte GmbH, Munich (DE)

(72) Inventors: Sarah Gluck Griswold, Powell, TN (US); Cemalettin Hasturk, Knoxville, TN (US); Ting Yi, Nanjing (CN)

(73) Assignees: BSH Home Applicances Corporation, Irvine, CA (US); BSH Hausgeräte GmbH, Munich (DE)

( * ) Notice: Subject to any disclaimer, the term of this patent is extended or adjusted under 35 U.S.C. 154(b) by 106 days.

(21) Appl. No.: 18/528,991

(22) Filed: Dec. 5, 2023

(65) Prior Publication Data

US 2025/0180277 A1 Jun. 5, 2025

(51) Int. Cl.

| | |
|---|---|
| ***F25D 25/00*** | (2006.01) |
| ***A47F 1/08*** | (2006.01) |
| ***F25D 23/04*** | (2006.01) |
| ***F25D 31/00*** | (2006.01) |

(52) U.S. Cl.

CPC ..... *F25D 25/00* (2013.01); *A47F 1/08* (2013.01); *F25D 23/04* (2013.01); *F25D 31/007* (2013.01); *F25D 2331/805* (2013.01); *F25D 2331/809* (2013.01)

(58) Field of Classification Search

CPC .... F25D 2331/805; F25D 25/00; F25D 23/04; F25D 31/007; F25D 23/02; F25D 23/028; F25D 2331/809; A47F 1/08; A47F 1/087; G07F 11/04

See application file for complete search history.

(56) References Cited

U.S. PATENT DOCUMENTS

| | | | | |
|---|---|---|---|---|
| 348,164 | A * | 8/1886 | Judson | A47F 1/08 312/45 |
| 691,990 | A | 1/1902 | Warren | |
| 1,614,017 | A * | 1/1927 | Nuhrah et al. | F25D 31/007 62/374 |

(Continued)

FOREIGN PATENT DOCUMENTS

| | | |
|---|---|---|
| CN | 1464269 A | 12/2003 |
| EP | 2562727 A1 | 2/2013 |

(Continued)

*Primary Examiner* — Hiwot E Tefera

(74) *Attorney, Agent, or Firm* — Michael E. Tschupp; Andre Pallapies; Brandon G. Braun

(57) ABSTRACT

A can rack system for a refrigeration appliance can be provided for receiving, storing, and dispensing cans. The can rack system can include a compartment for storing cans. The can rack system can also include a top cover defining a top side of the compartment. Additionally, a first bottom flap and a second bottom flap can define a bottom side of the compartment. The first bottom flap can be positioned parallel to and a first distance from the second flap to produce a bottom gap in the bottom side of the compartment. Moreover, a first front flap and a second front flap can define a front side of the compartment. The first front flap can be positioned parallel to and a second distance from the second front flap to produce a front gap in the front side of the compartment.

15 Claims, 13 Drawing Sheets

(56) References Cited

U.S. PATENT DOCUMENTS 1,673,812 A 6/1928 Dunn
1,714,469 A * 5/1929 Hoffman ..... A47F 1/08 242/146
1,753,957 A * 4/1930 Washburn ..... B65D 7/10 221/311
2,546,597 A * 3/1951 Harris ..... A47F 1/08 221/268
2,728,623 A * 12/1955 Foerstner ..... F25D 23/04 211/49.1
2,826,471 A 3/1958 Fonda
3,018,001 A * 1/1962 Combs ..... A47F 1/08 221/242
3,184,104 A * 5/1965 De Domenico ..... A47F 1/08 221/92
3,710,978 A 1/1973 Cosby
3,744,866 A * 7/1973 Cook ..... A47F 1/08 312/42
3,957,174 A * 5/1976 Palamara ..... A47F 1/08 221/111
4,889,260 A * 12/1989 Zeller ..... A63B 57/0032 221/197
5,228,590 A * 7/1993 Blasko ..... A47F 1/08 220/501
5,356,033 A 10/1994 Delaney
5,667,082 A * 9/1997 Hamilton ..... A47F 1/08 206/315.9
6,206,237 B1 * 3/2001 Dillon ..... B65G 1/08 221/312 R
D527,749 S 9/2006 Eveland et al.
8,608,263 B2 12/2013 Eveland et al.
9,400,132 B2 7/2016 Shrader et al.
10,610,342 B2 * 4/2020 Willes ..... A61C 13/082
10,919,702 B1 * 2/2021 Berta ..... B65G 11/04
2002/0185498 A1 * 12/2002 Riordan ..... G07F 11/04 221/196
2003/0046951 A1 * 3/2003 Kim ..... F25D 23/04 62/465
2005/0023939 A1 * 2/2005 Kramer ..... G07F 11/24 312/138.1
2005/0218153 A1 * 10/2005 Dejeu ..... A47F 1/08 221/251
2005/0241329 A1 * 11/2005 Castrellon ..... F25C 1/04 62/340
2006/0152122 A1 * 7/2006 Garrett ..... F25D 23/04 312/405.1
2006/0254302 A1 * 11/2006 Byrne ..... G07F 11/24 221/256
2007/0045336 A1 * 3/2007 Munoz ..... A47F 1/08 221/226
2007/0157655 A1 * 7/2007 Eveland ..... A47F 1/087 62/407
2013/0133352 A1 * 5/2013 Park ..... F25D 23/126 62/340
2013/0270978 A1 * 10/2013 Black ..... A47F 1/08 312/72
2015/0351536 A1 * 12/2015 Buenzow ..... A47F 1/08 211/59.3
2023/0036194 A1 * 2/2023 Jang ..... F25D 23/04
2023/0280091 A1 * 9/2023 Bertolini ..... F25D 23/126 312/212

FOREIGN PATENT DOCUMENTS

KR 10-0402606 B1 10/2003
KR 10-2006-0000214 A 1/2006

* cited by examiner

CAN RACK SYSTEM WITH OPENINGS DIMENSIONED TO PROTECT THE CAN RACK SYSTEM

TECHNICAL FIELD

The present disclosure relates generally to refrigeration systems and, more particularly (although not necessarily exclusively), to protecting a can rack system and items stored within the can rack system via openings in the can rack system.

BACKGROUND

Household appliances such as refrigerators can include shelves and drawers for storing items. The house appliances can also include specific compartments such as can racks. The can racks can be used to store canned drinks, canned foods, or the like to improve organization within the household appliance and to improve accessibility with respect to canned items. The can racks may be positioned in the refrigeration appliance and may take up significant space. Therefore, it may be desirable to design a can rack that can fit seamlessly around or near other features of a household appliance. Additionally, users may misuse can racks. For example, users may dispose of or position cans incorrectly within a can rack or may use the can rack to store non-canned items. Misuse of a can rack may cause damage to the non-canned items, cans, or to the can rack itself. Moreover, during production of refrigerators, ease of assembly of compartments such as can racks can lead to more refrigerators being produced in a shorter amount of time. In addition, if maintenance or other services involve disassembling a can rack, it may be advantageous for the can rack, to be removable from the refrigeration appliance using minimal tools.

DETAILED DESCRIPTION

Figure 1:
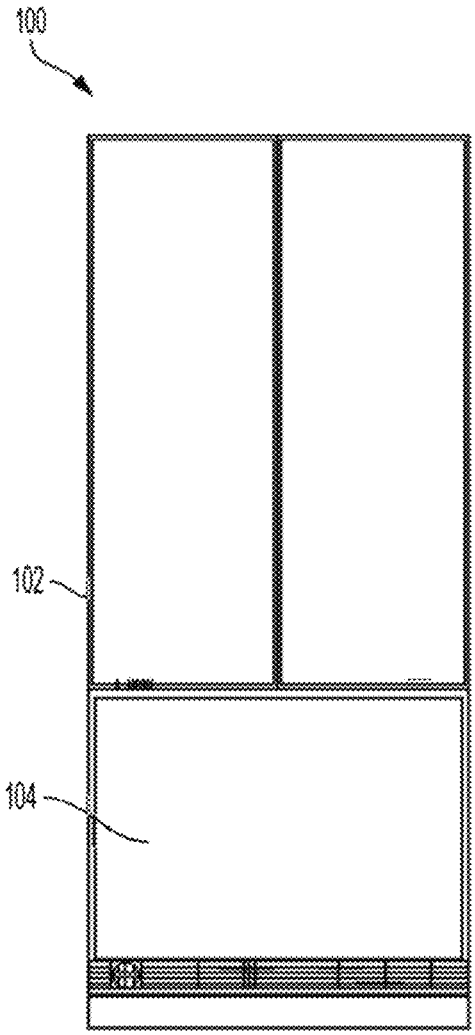
FIG. 1 depicts an example of a refrigeration appliance according to some embodiments of the present disclosure.

Certain aspects and examples of the present disclosure relate to a can rack system for storing and dispensing cans or other suitable objects of similar shape or size. More specifically, aspects and examples of the present disclosure are directed to a can rack system with a variety of openings and a top cover for protecting the can rack system. For example, if a user inserts a can incorrectly into the can rack system, the can may get become stuck in the can rack system. As a result, the can, the can rack system, or a combination thereof may be damaged or may be damaged in a process to remove the can that is stuck. Thus, to protect the can rack system and cans stored in the can rack system, the openings and the top cover can prevent users from incorrectly inserting cans into the can rack system.

In some examples, the can rack system can include a first front opening though which a user can insert cans into the can rack system. The can rack system can also include a second front opening through which the cans can be dispensed. For example, the first front opening can be within a top portion of a compartment of the can rack system and a second front opening can be within a bottom portion the compartment. Thus, a can may be inserted via the first front opening into the compartment. After insertion, the can may fall through the compartment to a bottom of the can rack system. The user may then retrieve the can from the can rack system via the second front opening. In some examples, the can rack system may have two or more compartments, which can each have a first and second opening.

The first and second front openings can be positioned, shaped, and sized to promote correct and safe insertion of cans in the can rack system. For example, the front openings can be rectangular with a width that is greater than a height to promote horizontal insertion of cans. Thus, the cans may not be inserted incorrectly (e.g., vertically) into the can rack system to prevent damage to the cans or the can rack system. Additionally, the front openings can be scaled based on a size of cans intended to be stored in the can rack system. For example, dimensions (e.g., a width and height) of the front openings may be greater than dimensions (e.g., a height and diameter) of the cans intended to be stored by a few millimeters (mm) (e.g., by 1, 2, 5, 10, etc. mm). Thus, the front openings can be slightly larger than the cans intended to be stored to enable the cans to be inserted and removed while minimizing a risk of the cans falling out of the can rack system. Additionally, the size of the first front opening can prevent cans that are too large for the can rack system from being inserted. Thus, the size of the first front opening can protect the can rack system from potential damage caused by storing oversized cans in the can rack system.

Additionally, the can rack system can include front flaps for retaining cans within the compartment of the can rack system. The front flaps can define a front side of the compartment. In some examples, each compartment of the can rack system can have two front flaps with a front gap in-between. The front gap can provide a space through which the user may adjust cans positioned in the can rack system. For example, the user may reach through the front gap to straighten a can that is not positioned horizontally within the compartment of the can rack system. In this way, the front gap can enable cans that are positioned incorrectly or stuck in the can rack system to be adjusted in a manner that is safe for the can rack system and for the cans. The front gap can be dimensioned to be small enough to prevent small cans (e.g., cans that are smaller than the cans intended to be stored in the can rack system) or other suitable objects from falling through a front of the can rack system. Additionally, the front gap between the front flaps can be small enough as to maintain a structural integrity of the compartment. The front gap can also be large enough for the user reach into the front of the can rack system to manipulate the cans as needed.

Similarly, the can rack system can include bottom flaps for retaining cans at the bottom of the can rack system before removal. The bottom flaps can define a bottom side of the compartment. Each compartment of the can rack system may have two bottom flaps with a bottom gap in-between. The user may reach through the bottom gap to lift cans out of the second front opening. Thus, the bottom gap can enable the user to control the removal of the cans to prevent damage to the can rack system or the cans during removal. The bottom gap can be dimensioned to be small enough to prevent the small cans or other suitable objects from falling through the bottom of the can rack system while being large enough for the user to reach through to lift up on a can during removal.

In some examples, the can rack system can be positioned in a refrigeration appliance. For example, the can rack system can be positioned on an inner side of a door of the refrigeration appliance. The can rack system may be configured to fit seamlessly around or near other features of the refrigeration appliance such as shelves, ice makers, or other suitable features. In a particular example, the can rack system may be positioned at least partially behind an ice maker on the door of the refrigeration appliance. Thus, the can rack system may include a top cut out and one or more back openings to enable a seamless fit of the can rack system behind the ice maker. The back of the can rack system can also include one or more vertical or horizontal back supports to provide structural support to the can rack system. The vertical or horizontal back supports can define a back side of the compartment. The top cut out, back openings, and vertical and horizontal back supports can be designed to allow enough clearance for the can rack system to slide on and off bolts, which may be on an inner liner of the icemaker or on another suitable portion of the door, without interference with the ice maker and other door features. In this way, the can rack system can be installed or removed from the refrigeration appliance without the icemaker or other suitable portions of the door damaging the can rack system. Additionally, top cut out, back openings, and vertical and horizontal back supports can enable the can rack system to be seamlessly integrated within the refrigeration appliance to minimize a volume of the refrigeration appliance taken up by the can rack system. Consequently, a usable volume within the refrigeration appliance is maximized.

By providing a can rack system with various openings (e.g., with the front openings, the front and bottom gaps, the back openings, and the top cutout, etc.) with specific positioning, sizes, and shapes, safety risks for the can rack system can be reduced. The safety risks can be associated with damaging cans in the can rack system or damaging the can rack system itself. The openings and other suitable features of the can rack system can further be dimensioned to enable a tool associated the can rack system, the refrigeration appliance, or a combination thereof to function efficiently and effectively. In this way, the tool can create, alter, or otherwise interact with the features of the can rack system or with the door maximize a manufacturing efficiency and an ease of installation of the can rack system.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 depicts an example of a refrigeration appliance 100 according to some embodiments of the present disclosure. The refrigeration appliance 100 can be a refrigerator, a freezer, or a combination thereof. For example, the refrigeration appliance 100 can include a first cabinet 102 defining a refrigeration space and a second cabinet 104 defining a freezer space. The first cabinet 102 and the second cabinet 104 may be arranged in various orientations, such as the first cabinet 102 positioned above the second cabinet 104 as depicted in FIG. 1. In another example, the first cabinet 102 may be positioned side by side or below the second cabinet 104, or in any other suitable arrangement. The first cabinet 102 or the second cabinet 104 may include a can rack, such as the can rack system 300 depicted in FIG. 3. The first cabinet 102 or the second cabinet 104 may further include an ice maker. For example, the ice maker can be positioned on an inner side of a door of the first cabinet 102 and the can rack system can be coupled to the ice maker.

Figure 2:
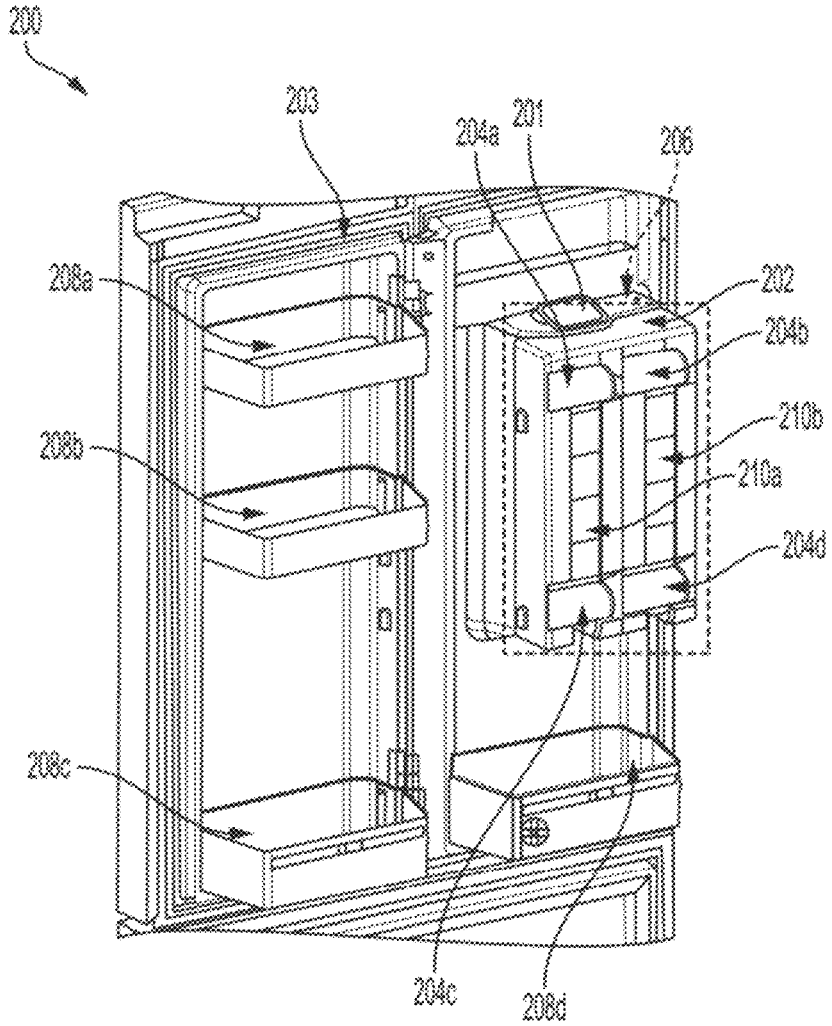
FIG. 2 depicts an example of a can rack system in a refrigeration appliance according to some embodiments of the present disclosure.

FIG. 2 depicts an example of a can rack system 201 in a refrigeration appliance 200 according to some embodiments of the present disclosure. In particular, FIG. 2 depicts an inner side of a door 203 of the refrigeration appliance 200. The refrigeration appliance 200 can correspond to the refrigeration appliance 100 depicted in FIG. 2. The door 203 can include trays 208*a-d*. In some examples, the door 203 may also include drawers, shelves, or other suitable components. The door 203 can further include an icemaker 206 on which the can rack system 201 can be coupled. For example, an inner line of the icemaker 206 may include bolts and a back side of the can rack system 201 can include hook mechanisms. The hook mechanisms can at least partially encompass the bolts to couple the can rack system 201 to the icemaker 206. The can rack system 201 may also include one or more back openings shaped and sized to fit around the icemaker 206 to seamlessly integrate the can rack system 201 on to the door 203.

The can rack system 201 can further include front openings 204*a-d*. A first set of front openings 204*a-b* can be at a top of the can rack system 201 directly below a top cover 202. A user may insert cans into the can rack system 201 via a first set of front openings 204*a-b*. As will be discussed in further detail below, the first set of front openings 204*a-b* can be of a particular shape and dimension to facilitate correct insertion of cans into the can rack system 201. In this way, a risk of damage to the can rack system can be minimized. Additionally, a second set of front openings 204*c-d* can be at a bottom of the can rack system 201. The user may use the second set of front openings 204*c-d* to retrieve the cans from the can rack system 201. The can rack system 201 can also include front gaps 210*a-b*. The front gaps 210*a-b* be sized to maintain cans within the can rack system 201 while providing a space through which the user can reposition the cans. For example, the user may reach through one of the front gaps 210*a-b* to adjust a can that is not positioned horizontally within the can rack system 201.

Figure 3:
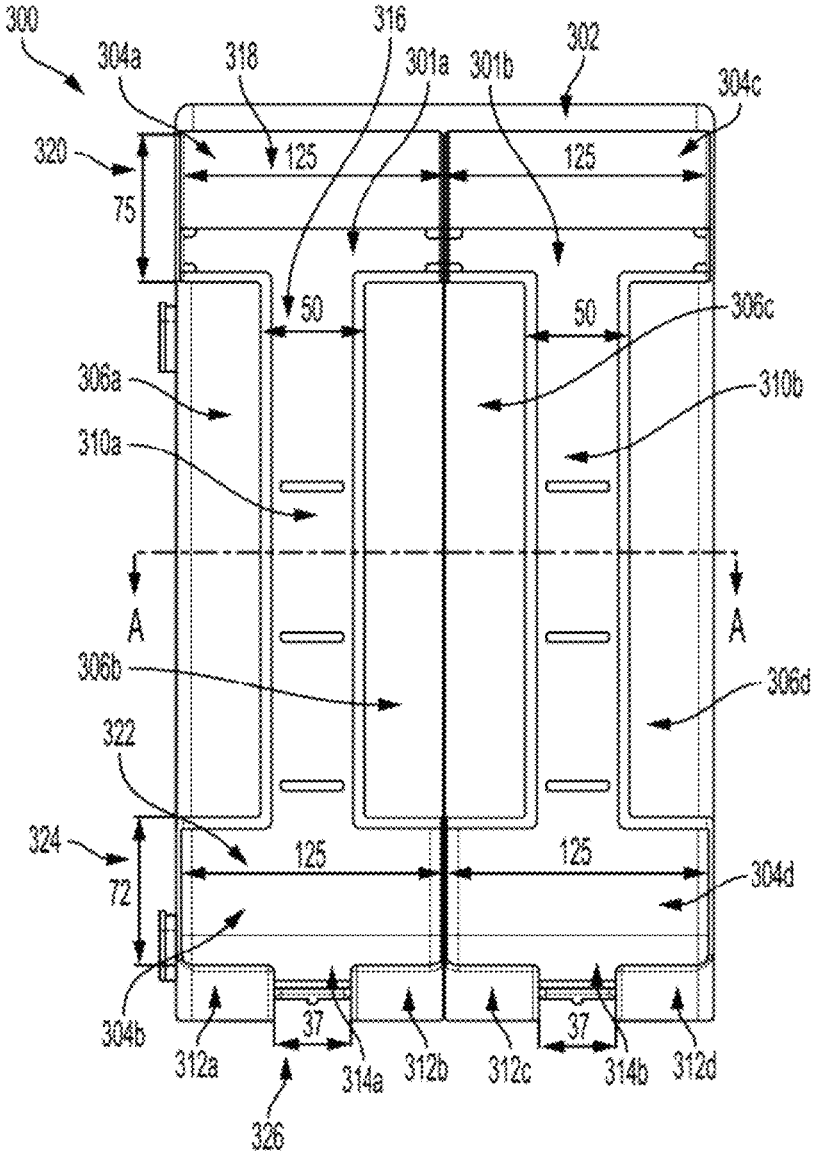
FIG. 3 depicts a front view of a can rack system with openings dimensioned to protect the can rack system according to some embodiments of the present disclosure.

FIG. 3 depicts a front view of a can rack system 300 with openings dimensioned to protect the can rack system 300 according to some embodiments of the present disclosure. The can rack system 300 can correspond to the can rack system 201 of FIG. 2. The can rack system 300 can be positioned in a refrigeration appliance, such as the refrigeration appliance 100 depicted in FIG. 1. For example, the can rack system 300 can be positioned at least partially behind an ice maker on a door of the refrigeration appliance 100.

The can rack system 300 can include a top cover 302 defining a top side of the can rack system 300. In some examples, the can rack system 300 can include a first compartment 301*a* and a second compartment 301*b*. In some examples, a center wall can separate the compartments 301*a-b*. In other examples, the can rack system 300 may consist of a different number of compartments, or the compartments may not be separated by a wall. Cans may be stored in each of the compartments 301*a-b*. For example, each of the compartments 301*a-b* may store up to six cans. In other examples, the compartments 301*a-b* may store up to a different number of cans. The top cover 302 can define a top side of the first compartment 301*a* and of the second compartment 301*b*. The top cover 302 can prevent users from dropping cans into the rack from above, which can cause damage to the cans or the can rack system 300. The top cover 302 can further prevent users from inserting cans incorrectly (e.g., vertically) in the can rack system 300. The top cover 302 can be coupled with at least two walls of the can rack system 300 to provide structural support to the walls. For example, the first compartment 301*a* can have a first outer side wall and a center wall. The second compartment 301*b* can also have a second outer side wall and can share the center wall with the first compartment 301*a*. Thus, the top cover 302 can be coupled with first and second outer side walls. In some examples, the top cover 302 can also be coupled with the center wall. Additionally, in some examples, the top cover 302 may be used as a shelf within the refrigeration appliance.

The can rack system 300 can further include front flaps 306*a-d*. A first front flap 306*a* and a second front flap 306*b* can define a front side of the first compartment 301*a*. Similarly, a third front flap 306*c* and a fourth front flap 306*d* can define a front side of the second compartment 301*b*. The front flaps 306*a-d* can be sized and positioned to prevent cans from falling out of the front sides of the compartments 301*a-b*.

The front flaps 306*a-d* can each have a length that is less than a height of the compartments 301*a-b*. For example, the height of each of the compartments 301*a-b* within the can rack system 300 can be about four-hundred and fifty millimeters (mm), and the length of the front flaps 306*a-d* can be about three-hundred and five mm. Due to the length and positioning of the front flaps 306*a-d*, the can rack system 300 can further include front openings 304*a-d* in the front sides of the compartments 301*a-b*. For example, a first front opening 304*a* can be a rectangular opening in the front side of the can rack system 300 above the first front flap 306*a* and the second front flap 306*b*. Additionally, a second front opening 304*b* can be a rectangular opening in the front side of the can rack system 300 below the first front flap 306*a* and the second front flap 306*b*. Similarly, there can be a third front opening 304*c* in the front side of the second compartment 301*b* above the third front flap 306*c* and the fourth front flap 306*d*. There can also be a fourth front opening 304*d* in the front side of the second compartment 301*b* below the third front flap 306*c* and the fourth front flap 306*d*.

The first front opening 304*a* and the third front opening 304*c* can further be directly below the top cover 302. The first front opening 304*a* can be used for inserting cans into the first compartment 301*a*. The second front opening 304*b* can be used for inserting cans into the second compartment 301*b*. The first front opening 304*a* and the third front opening 304*c* may each have a first width 318 and a first height 320. The first width 318 and the first height 320 can be determined based on a type of can intended to be inserted into, stored in, and dispensed from the compartments 301*a-b*. For example, the first width 318 and the first height 320 can be slightly larger (e.g., one, two, seven, etc. mm larger) than a diameter and a height of the type of can. In a particular example, a standard can may have a height of one-hundred and twenty-three mm and a diameter of sixty-six mm. Thus, in the particular example, the first width 318 may be about one-hundred and twenty-five mm and the first height 320 may be about seventy-three mm. Due to the first height 320 and first width 318 being based on dimensions of the type of can, the first front opening 304*a* and the third front opening 304*c* can promote horizontal insertion of cans into the can rack system 300. This can minimize a risk of damage to cans or the can rack system 300 or other undesirable effects of incorrect (e.g., vertical) insertion of cans into the can rack system 300.

Additionally, the second front opening 304*b* can provide a space through which a user may retrieve cans from the first compartment 301*a*. The fourth front opening 304*d* can provide a space through which the user may retrieve cans from the second compartment 301*b*. The second front opening 304*b* and the fourth front opening 304*d* may each have a second width 322 and a second height 324. The second width 322 and the second height 324 can also be based on the type of can intended to be inserted into, stored in, and dispensed from in the compartments 301*a-b*. For example, for the standard can with the height of one-hundred and twenty-three mm and the diameter of sixty-six mm, the second height 324 can be seventy-two mm and the second width 322 can be one-hundred and twenty-five mm. The second height 324 may be smaller than the first height 320 to decrease a risk of the cans falling out of the second front opening 304*b* or the fourth front opening 304*d* prior to being removed by the user.

In some examples, the first front flap 306*a* and the second front flap 306*b* can be parallel to and a first distance 316 from one another to produce a first front gap 310*a*. The third front flap 306*c* and the fourth front flap 306*d* can also be parallel to and the first distance 316 from one another to produce a second front gap 310*b*. The front gaps 310*a-b* can span a length of the front flaps 306*a-d*. The front gaps 210*a-b* can provide a space through which the user may adjust cans positioned in the compartments 301*a-b* of the can rack system 300. For example, the user may turn a can that is not positioned horizontally within the first compartment 301*a* via the first front gap 310*a*. Additionally, the front gaps 310*a-b* can be small enough as to not decrease a structural strength of the can rack system 300. The front gaps 310*a-b* can also be small enough that a smallest type of can (e.g., a sample-sized can) cannot fall out of the front sides of the compartments 301*a-b*. For example, a sample-sized can may have a diameter of fifty-one mm. Therefore, the first distance 316 between flaps that produces the front gaps 310*a-b* can be fifty mm.

The can rack system 300 can further include bottom flaps 312*a-d*, which can prevent cans from falling out of a bottom side of the can rack system 300. A first bottom flap 312*a* and a second bottom flap 312*b* can define a bottom side of the first compartment 301*a*. Additionally, a third bottom flap 312*c* and a fourth bottom flap 312*d* can define a bottom side the second compartment 301*b*. The first bottom flap 312*a* and the second bottom flap 312*b* can be parallel to and spaced a second distance 326 from one another to produce a first bottom gap 314*a*. The third bottom flap 312*c* and the fourth bottom flap 312*d* can also be parallel to and spaced the second distance 326 from one another to produce a second bottom gap 314*b*. The bottom gaps 314*a-b* can provide a space through which the user may interact with cans. For example, a user may use the second bottom gap 314*b* to lift a can out of the second compartment 301*b* via the fourth front opening 304*d*. Thus, the second distance 326 can be large enough for a user to reach through. For example, the second distance 326 may be thirty-seven mm.

Figure 4:
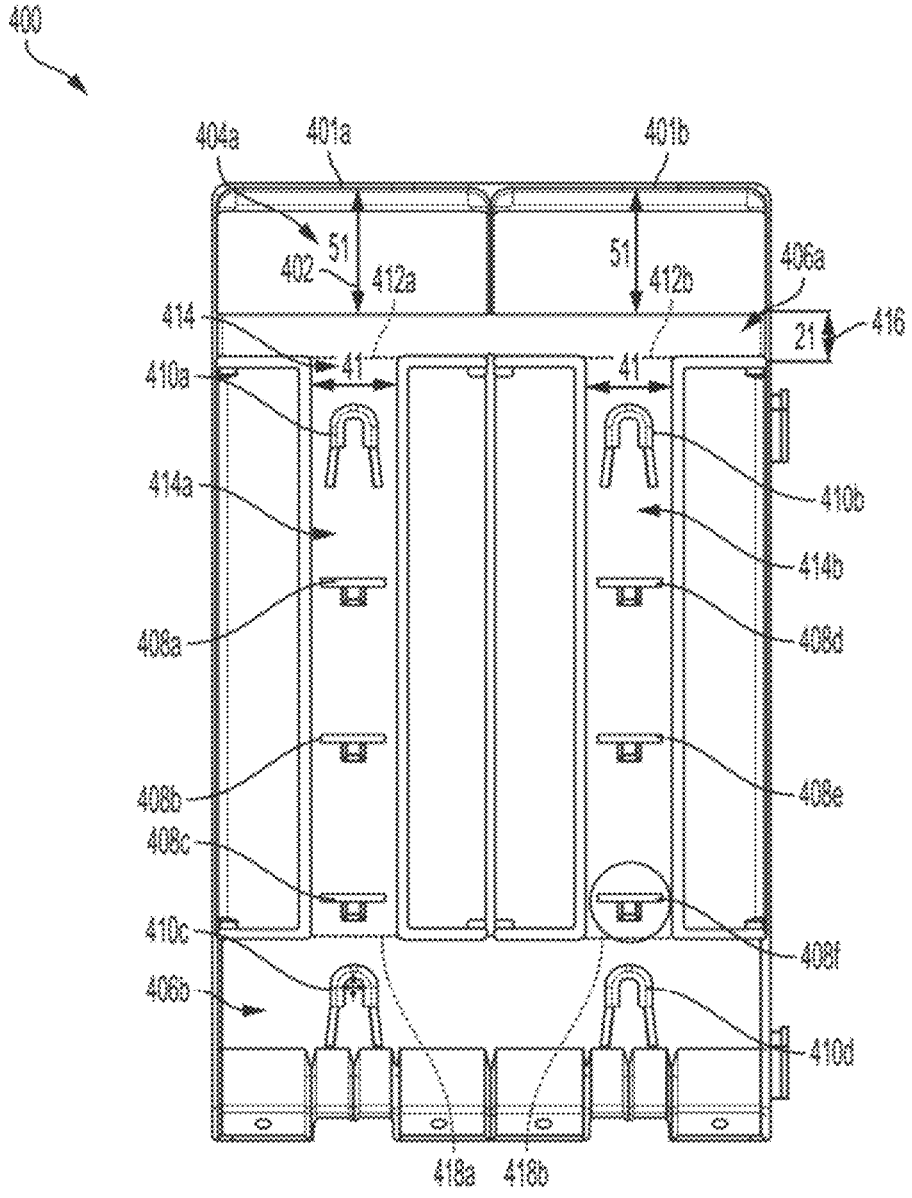
FIG. 4 depicts a back view of a can rack system with openings dimensioned to protect the can rack system according to some embodiments of the present disclosure.

FIG. 4 depicts a back view of a can rack system 400 with openings dimensioned to protect the can rack system 400 according to some embodiments of the present disclosure. The can rack system 400 can correspond to the can rack system 201 of FIG. 2. The can rack system 400 can be positioned in a refrigeration appliance, such as the refrigeration appliance 100 depicted in FIG. 1.

The can rack system 400 can include horizontal back supports 406*a-b* and vertical back supports 414*a-b*. The horizontal back supports 406*a-b* and a first vertical back support 414*a* can define a back side of a first compartment 401*a* of the can rack system 400. Additionally, the horizontal back supports 406*a-b* and a second vertical back support 414*b* can define a back side of a second compartment 401*b* of the can rack system 400. In this way, the horizontal back supports 404*a-b* and the vertical back supports 414*a-b* can prevent cans from falling out of the back sides of the compartments 401*a-b*. The horizontal back supports 404*a-b* and the vertical back supports 414*a-b* can further provide structural support to the can rack system 400.

More specifically, in some examples, the horizontal back supports 406*a-b* can span a width of the can rack system 400. In an example, a first horizontal back support 406*a* can have a first height 416 of twenty-one millimeters (mm). The first height 416 and the spanning of the width of the can rack system 400 by the first horizontal back support 406*a* can enable the first horizontal back support 406*a* to provide structural support to the can rack system 400. A second horizontal back support 406*b* can be positioned at a bottom of the back side of the can rack system 400 directly above bottom flaps, such as the bottom flaps 312*a-d* depicted in FIG. 3. The second horizontal back support 406*b* can also span the width of the can rack system 400 and may have second height that is greater than the first height 416. The second height may be greater than the first height to enable the second horizontal back support 406*b* to prevent cans positioned at the bottom of the can rack system 400 from falling out of the back sides of the compartments 401*a-b*. Additionally, the vertical back supports 414*a-b* can span a length of the can rack system 400 from the first horizontal back support 406*a* to the second horizontal back support 406*b*. As depicted, a first top edge 412*a* of the first vertical back support 414*a* can be connected to the first horizontal back support 406*a* and a first bottom edge 418*a* of the first vertical back support 414*a* can be connected to the second horizontal back support 406*b*. Additionally, a second top edge 412*b* of the second vertical back support 414*b* can be connected to the first horizontal back support 406*a* and a second bottom edge 418*b* of the second vertical back support 414*b* can be connected to the second horizontal back support 406*b*. The vertical back supports 414*a-b* can each have a first width 414 of sixty-one mm. A smallest type of can (e.g., a sample-sized can) may have a diameter of 51 mm. Thus, the first width 414 can enable the vertical back supports 414*a-b* to maintain a position of the smallest type of can or any other suitable can type in the compartments 401*a-b*.

There can further be openings in the back side of the compartments 401*a-b* around the vertical back supports 414*a-b* and the horizontal back supports 406*a-b*. For example, there can be a first back opening 404*a* in the back side of the first compartment 401*a* and a second back opening 404*b* in the back side of the second compartment 401*b*. The back openings 404*a-b* can be above the first horizontal back support 406*a*. In a particular example, each of the back openings 404*a-b* can have a third height 402 of fifty-seven mm and may have a second width of one-hundred and twenty-five mm. Additionally, the back openings 404*a-b* may be separated by a center wall of the can rack system 400. In other examples, the center wall may only extend a portion of a depth of the can rack system 400 (e.g., half of the depth), and therefore may not or may only partially separate the back openings 404*a-b*.

Additionally, the vertical back supports 414*a-b* and the horizontal back supports 414*a-b* can be sized and positioned to enable the can rack system 400 to fit behind or near an ice maker of the refrigeration appliance. In this way, the can rack system 400 can be seamlessly integrated within the refrigeration appliance to maximize usable volume within the refrigeration appliance.

For example, to position the can rack system 400 in refrigeration appliance the can rack system 400 can include hook mechanisms 410*a-d*. The hook mechanisms 410*a-d* can be positioned on the vertical back supports 414*a-b*, on the horizontal back supports 406*a-b*, or a combination thereof. The positioning of the hook mechanisms 410*a-d* can correspond to bolts on the refrigeration appliance. The hook mechanism 410*a-b* can hook on to the bolts to couple the can rack system 400 to the refrigeration appliance. For example, an inner liner of an ice maker in the refrigeration appliance can include the bolts. The can rack system 400 can be positioned such that the hook mechanisms 410*a-d* are aligned with and above the bolts. The back openings 404*a-b* in the can rack system 400 can provide a space for fitting the can rack system 400 around the icemaker to enable the hook mechanisms 410*a-d* to be aligned with the bolts. Then, further due to the space provided by the back openings 404*a-b*, the can rack system 400 can be slid downward to hook the hook mechanisms 410*a-d* around the bolts. The hook mechanisms 410*a-d* can each include a lower portion that is wider than an upper portion to facilitate the aligning of the hook mechanism 410*a-d* above the bolts. Then, the upper portion can be sized to fit securely around the bolts when the can rack system 400 is moved downward.

The can rack system 400 can also include back slots 408*a-f* through which back bumpers can be inserted. The back slots 408*a-f* can each be positioned on the vertical back supports 414*a-b*, on the horizontal back supports 406*a-b*, or a combination thereof. The back slots 408*a-f* can each have a height that is large enough to allow the back bumper to be installed, but small enough such that the back bumper connection can be hidden when the can rack system 400 is installed in the refrigeration application. The back bumpers can slow cans inserted into the can rack system 400 as the cans fall through the compartments to the bottom of the can rack system 400 or on to another can. In this way, the back bumpers can minimize damage to the cans, the can rack system 400, or a combination thereof associated with an impact of cans inserted into the compartments.

Figure 5:
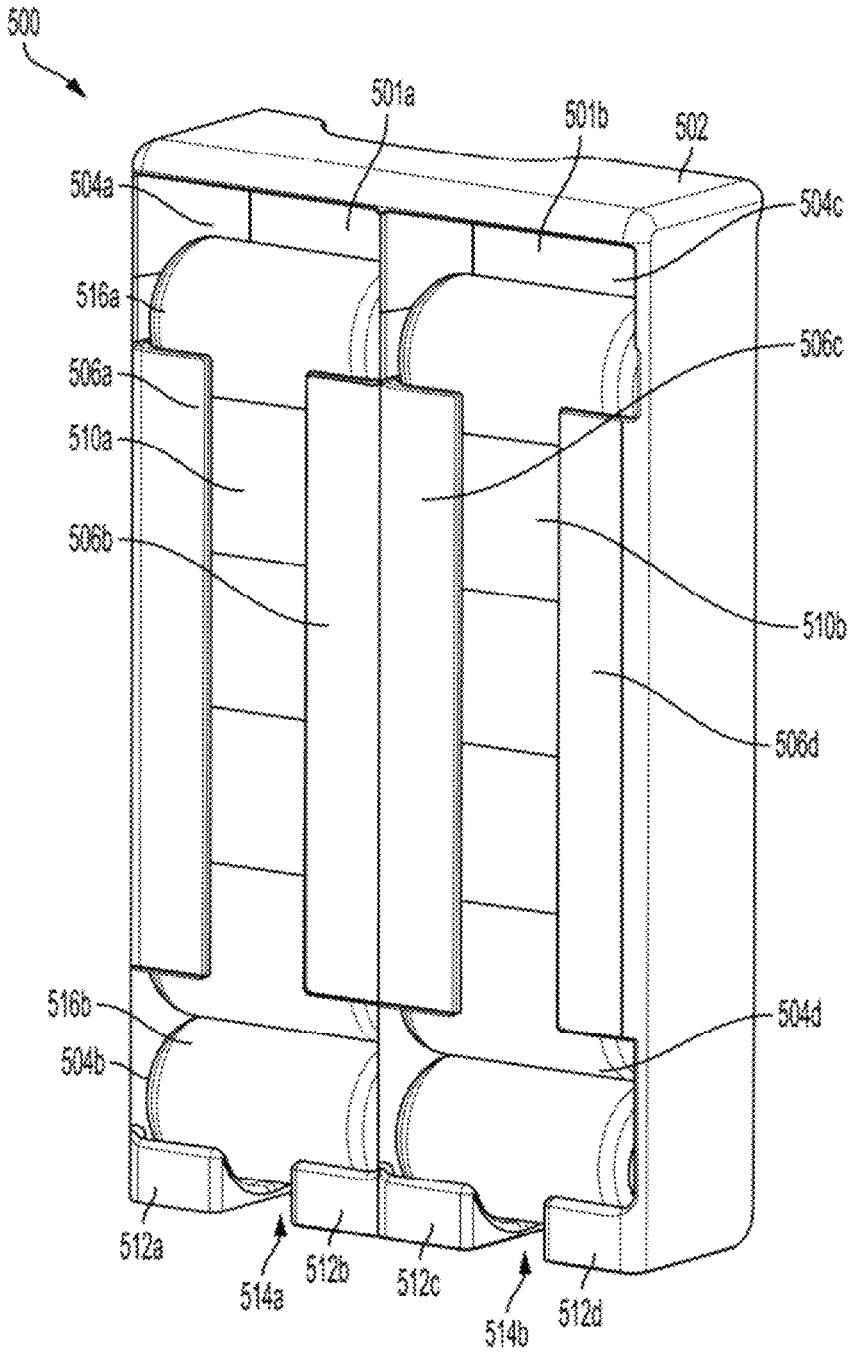
FIG. 5 depicts another front view of a can rack system with openings dimensioned to protect the can rack system according to some embodiments of the present disclosure.

FIG. 5 depicts another front view of a can rack system 500 with openings dimensioned to protect the can rack system 500 according to some embodiments of the present disclosure. The can rack system 500 can include a top cover 502 for preventing users from dropping cans into the can rack system 500 from above, which can cause damage to the cans or to the can rack system 500 itself. The can rack system 500 can further include a first front opening 504*a* and a third front opening 504*c* directly below the top cover 502. The first front opening 504*a* and the third front opening 504*c* can be greater in width than height to promote horizontal insertion of cans into the can rack system 500. The height and width of the first front opening 504*a* and the third front opening 504*c* can further be scaled based on a height and diameter of a type of can (e.g., standard soda cans) intended to be stored in the can rack system 500. Thus, the height and width of the first front opening 504*a* and the third front opening 504*c* can promote horizontal insertion of the type of can for which the can rack system is intended. The height and width can further enable a user to store cans smaller than the intended type of can and prevent the user from storing cans that are larger than the intended type of can. Thus, the can rack system 500 can be used to store various can types, but cans that may be too large and therefore may damage the can rack system 500 cannot be inserted.

The can rack system 500 can also include a second front opening 504*b* and a fourth front opening 504*d*, which can be positioned directly above bottom flaps 512*a-d*. The second front opening 504*b* and the fourth front opening 504*d* can also be greater in width than height to enable the cans, which are preferably horizontal in the can rack system 300, to be removed from the can rack system 500. The height and width of the second front opening 504*b* and the fourth front opening 504*d* can also be scaled based on the height and diameter of the type of can (e.g., standard soda cans) intended to be stored in the can rack system 500. In some examples, the height of the second front opening 504*b* and the fourth front opening 504*d* d can be smaller than the height of the first front opening 504*a* and the third front opening 504*c*. This can minimize a risk of cans that fall, through compartments 501*a-b* of the can rack system 500, to the bottom of the can rack system 500 from bouncing or otherwise falling out of the second front opening 504*b* or the fourth front opening 504*d*

Additionally, the can rack system 500 can have front flaps 506*a-d*. A first front flap 506*a* and a second front flap 506*b* can be associated with a first compartment 501*a* of the can rack system 500. The first front flap 506*a* and the second front flap 506*b* can be a first distance apart to create a first front gap 510*a* in the first compartment 501*a*. Similarly, a third front flap 506*c* and a fourth front flap 506*d* can be associated with a second compartment 501*b* of the can rack system 500. The third front flap 506*c* and the fourth front flap 506*d* can be the first distance apart to create a second front gap 510*b* in the second compartment 501*b*. The first distance may be about fifty millimeters (mm). The first front gap 510*a* can span from the first front opening 504*a* to the second front opening 504*b*, and the second front gap 510*b* can span from the third front opening 504*a* to the fourth front opening 504*d*. The front gaps 510*a-b* can provide a space through which a user can adjust cans that are incorrectly positioned in the compartments of the can rack system.

The can rack system 500 can also include bottom gaps 514*a-b*. A first bottom gap 514*a* can be at a bottom of the first compartment 501*a* of the can rack system 500 between a first bottom flap 512*a* and a second bottom flap 512*b*. Similarly, a second bottom gap 514*b* can be at a bottom of the second compartment 501*b* of the can rack system 500 between a third bottom flap 512*c* and a fourth bottom flap 512*d*. The bottom gaps 514*a-b* can enable a user to lift cans out of the can rack system 500 through the front openings 504*c-d*.

In a particular example, a first can 516*a* can be inserted into the first compartment 501*a* of the can rack system 500 via the first front opening 504*a*. Due to the dimensions of the height and width of the first front opening 504*a*, the first can 516*a* can be in a horizontal position in the can rack system 500. The first can 516*a* can also be on a stack of cans stored in the first compartment 501*a*. At a bottom of the stack of cans, there can be a second can 516*b*. The second can 516*b* may be removed from the can rack system 500 via the third front opening 504*c*.

Figure 6:
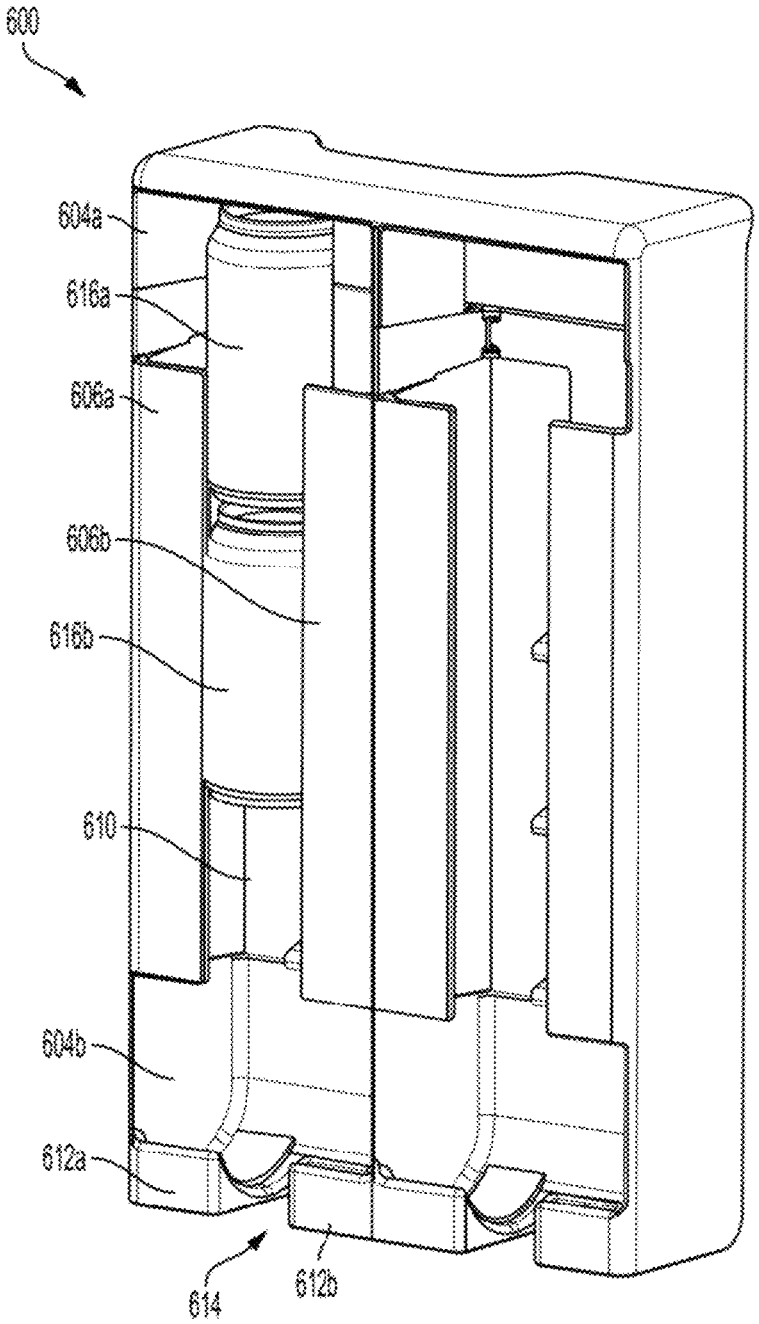
FIG. 6 depicts another front view of a can rack system with openings dimensioned to protect the can rack system according to some embodiments of the present disclosure.

FIG. 6 depicts another front view of a can rack system 600 with openings dimensioned to protect the can rack system 600 according to some embodiments of the present disclosure. For example, the can rack system 600 can include a first front opening 604*a* through which cans can be inserted into the can rack system 600. The can rack system 600 can also include a second front opening 604*b* through which cans maybe dispensed from the can rack system 600. The front openings 604*a-b* can be greater in width than height to promote horizontal positioning of cans into the can rack system.

But, as depicted, in some examples, a user may insert cans 616*a-b* vertically in the can rack system 600. To prevent damage to the cans from, for example, the cans falling out of the can rack system a front gap 610 of the can rack system 600 can have a width that is smaller than a diameter of the cans 616*a-b*. Thus, the can rack system 600 can be structured to prevent damage to incorrectly positioned cans. Additionally, the front gap 610 can provide a space through which a user can reach to reposition the cans. In this way, the cans 616*a-b* positioned incorrectly will not get stuck in the can rack system 600 to minimize a risk of damage to the cans 616*a-b* or the can rack system 600.

Once the cans 616*a-b* are adjusted to a horizontal position within the can rack system 600, the cans 616*a-b* may fall toward a bottom of the can rack system 600. As a result, the second can 616*b* can be on top of bottom flaps 612*a-b*. The user may then retrieve the second can 616*b* via the second front opening 604*b*. To do so, the user may use bottom gap 614 to lift the second can 616*b* out of the second front opening 604.

Figure 7:
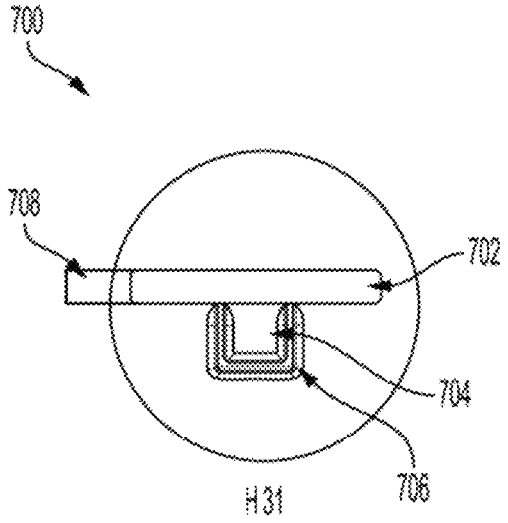
FIG. 7 depicts an example of a back slot of a can rack system for receiving a back bumper according to some embodiments of the present disclosure.

FIG. 7 depicts an example of a back slot 700 of a can rack system for receiving a back bumper according to some embodiments of the present disclosure. The back slot 700 can be on a back side of the can rack system. For example, the back slot 700 can correspond to one of the back slots 408*a-f* depicted in FIG. 4 and can be positioned on a vertical back support, a horizontal back support, or a combination thereof of the can rack system. The back slot 700 can be dimensioned such that a back bumper can be removably coupled to the can rack system via the back slot 700. For example, the back slot 700 may have a height of 5 mm. The back bumper can have a flange 702 with a thickness of less than 5 mm. Thus, the flange 702 of the back bumper can be inserted through the back slot 700. Additionally, the flange can have a flange hole 706, which can fit around a protruding portion 704. The protruding portion 704 can be positioned on the vertical back supports or horizontal back supports of the can rack system below the back slot 708. As a result of inserting the flange 702 through the back slot 700 and coupling the flange hole 706 around the protruding portion 704, a flexible flap of the back bumper can be positioned in a compartment of the can rack system. The flexible flap can provide resistance to force exerted by cans falling through the can rack system to slow the cans. In this way, the back bumper can minimize a risk of the force of the cans causing damage to one another or to the can rack system.

Figure 8:
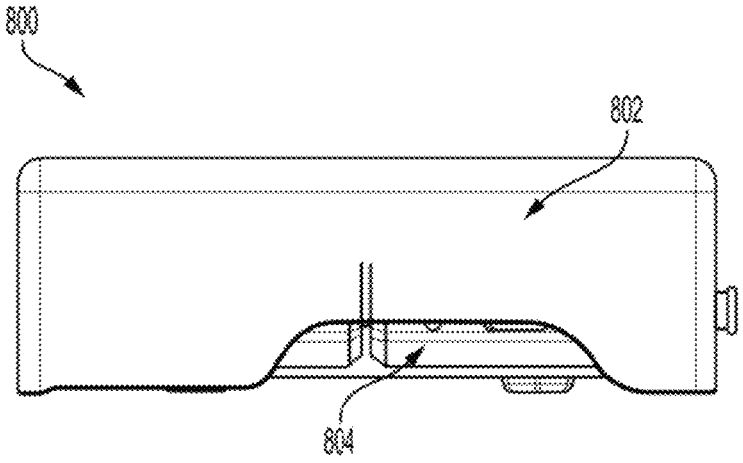
FIG. 8 depicts a top view of a can rack system with openings dimensioned to protect the can rack system according to some embodiments of the present disclosure.

FIG. 8 depicts a top view of a can rack system 800 with openings for reducing risk for the can rack system 800 according to some embodiments of the present disclosure. The can rack system 800 can include a top cutout 804 within a top cover 802 of the can rack system 800. The top cutout 804 can be used to position the can rack system 800 seamlessly around components of a refrigeration appliance. For example, the can rack system 800 can be positioned at least partially behind an ice maker. Thus, the ice maker may be partially disposed within the top cutout 804. Additionally, the can rack system 800 may be coupled to the icemaker by sliding the can rack system 800 downward to cause hook mechanisms on the can rack system 800 to at least partially encompass bolts on the icemaker. Thus, the top cut out 804 can enable the can rack system 800 to be slid downward without interference from the icemaker. The use of the top cutout 804 to fit around the ice maker or other suitable components of the door can further maximize usable space within the refrigeration appliance.

Figure 9:
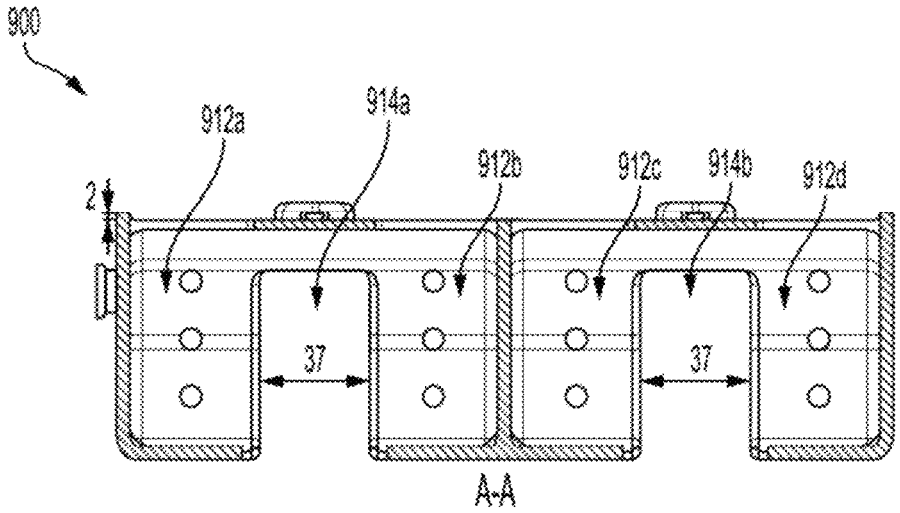
FIG. 9 depicts a bottom view of a can rack system with openings dimensioned to protect the can rack system according to some embodiments of the present disclosure.

FIG. 9 depicts a bottom view of a can rack system 900 with openings for reducing risk for the can rack system 900 according to some embodiments of the present disclosure. The can rack system 900 may have bottom flaps 912*a-d*. As depicted, a first bottom flap 912*a* and a second bottom flap 912*b* can be parallel to and a distance 902 from one another to create a first bottom gap 914*a*. Additionally, a third bottom flap 912*c* and a fourth bottom flap 912*d* can be parallel to and the distance from one another to create a second bottom gap 914*b*. The distance 902 of the bottom gaps 914*a-b* can be large enough for a user to reach through to help the user lift a can out of the can rack system 900. The distance 902 can also be small enough to prevent cans from falling through the bottom gap. For example, the distance 902 can be about thirty-seven millimeters (mm).

Figure 10:
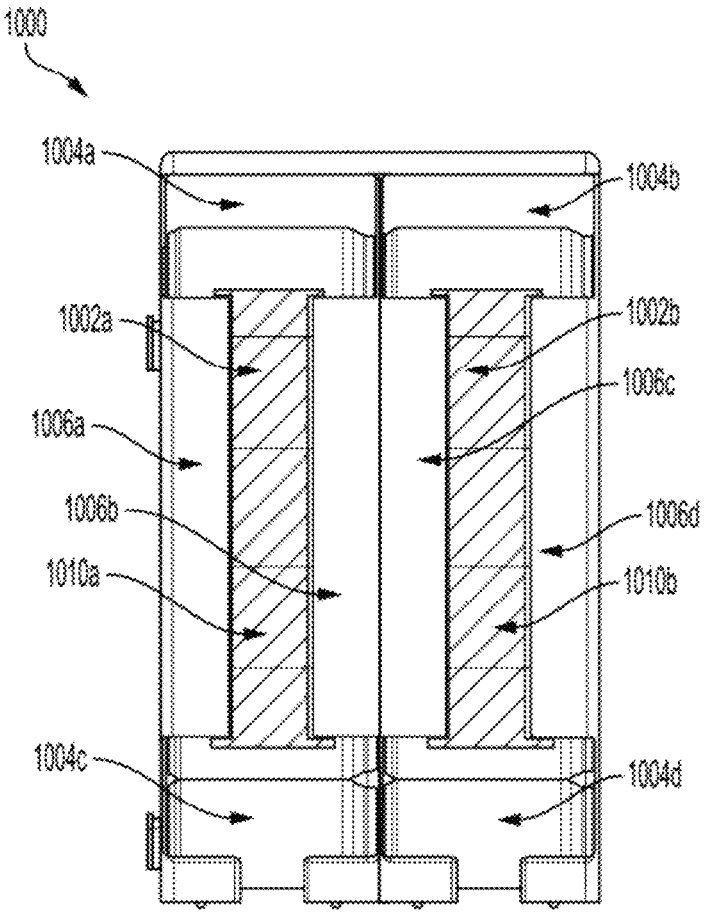
FIG. 10 depicts an example of a can rack system with front covers according to some embodiments of the present disclosure.

FIG. 10 depicts an example of a can rack system 1000 with front covers 1002*a-b* according to some embodiments of the present disclosure. The front covers 1002*a-b* can be removably coupled to front flaps 1006*a-d* of the can rack system 1000. For example, a first front cover 1002*a* can be positioned between a first front flap 1006*a* and a second front flap 1006*b*. Additionally, a second front cover 1002*b* can be positioned between a third front flap 1006*c* and a fourth front flap 1006*d*. The front covers 1002*a-b* may be removably coupled with the front flaps 1006*a-b* via snaps or another suitable mechanism. The front covers 1002*a-b* can be a similar length as the front flaps 1006*a-d*. In this way, the first front cover 1002*a* can cover a first front gap 1010*a* between front flaps 1006*a-b* and the second front cover 1002*b* can cover a second front gap 1010*b* between the front flaps 1006*c-d*. Additionally, the front covers 1002*a-b* may not cover front openings 1004*a-d* to enable insertion and removal of cans from the can rack system 1000.

Figure 11:
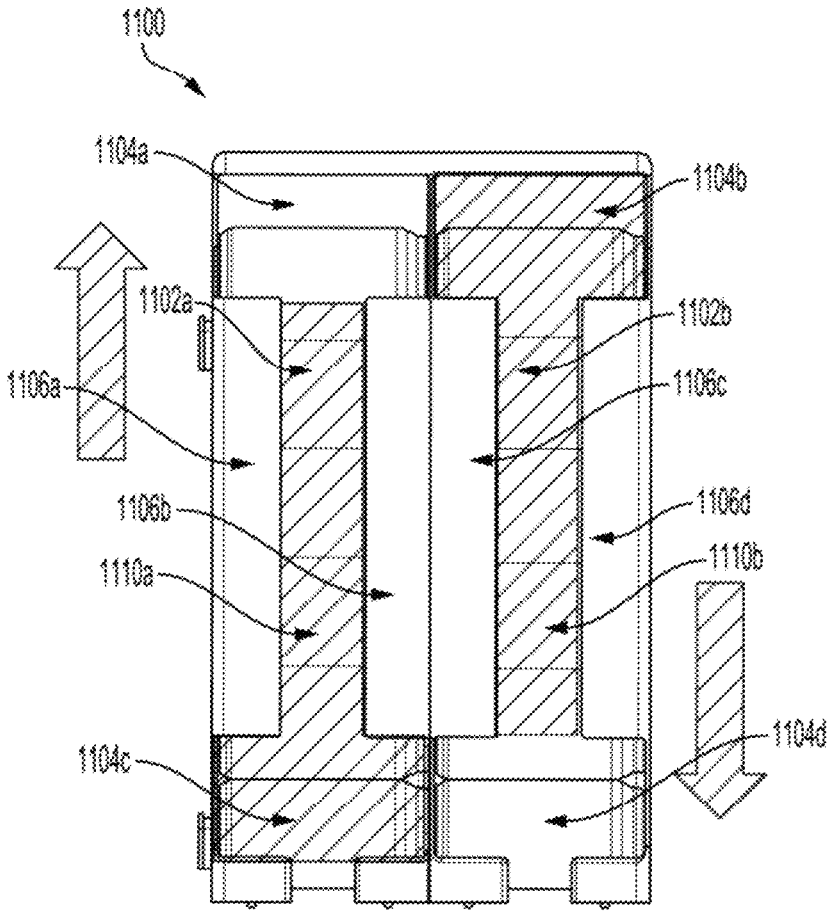
FIG. 11 depicts another example of a can rack system with front covers according to some embodiments of the present disclosure.

FIG. 11 depicts another example of a can rack system 1100 with front covers 1102*a-d* according to some embodiments of the present disclosure. The front covers 1102*a-b* can be removably coupled to front flaps 1106*a-d* of the can rack system 1000. For example, a first front cover 1102*a* can be positioned between a first front flap 1106*a* and a second front flap 1106*b*. Additionally, a second front cover 1102*b* can be positioned between a third front flap 1106*c* and a fourth front flap 1106*d*. The front covers 1102*a-b* may be removably coupled with the front flaps 1006*a-b* by sliding behind the front flaps 1106*a-d*, by snaps, or by another suitable mechanism. The front covers 1102*a-b* can be long enough to span a length of the front flaps 1106*a-d* and one of the front openings 1104*a-d*. For example, as depicted, the first front cover 1102*a* can be in a first position in which the first front cover 1102*a* can cover a first front gap 1110*a* between the front flaps 1106*a-b* and a third front opening 1104*c*. In another example, as depicted, the second front cover 1102*b* can be in a second position in which the second front cover 1002*b* can cover a second front gap 1110*b* between the front flaps 1106*c-d* and a second front opening 1104*b*. The front covers 1102*a-b* can be slid upward or downward to change which of the front openings 1104*a-d* are covered to enable insertion and removal of cans from the can rack system 1100.

Figure 12:
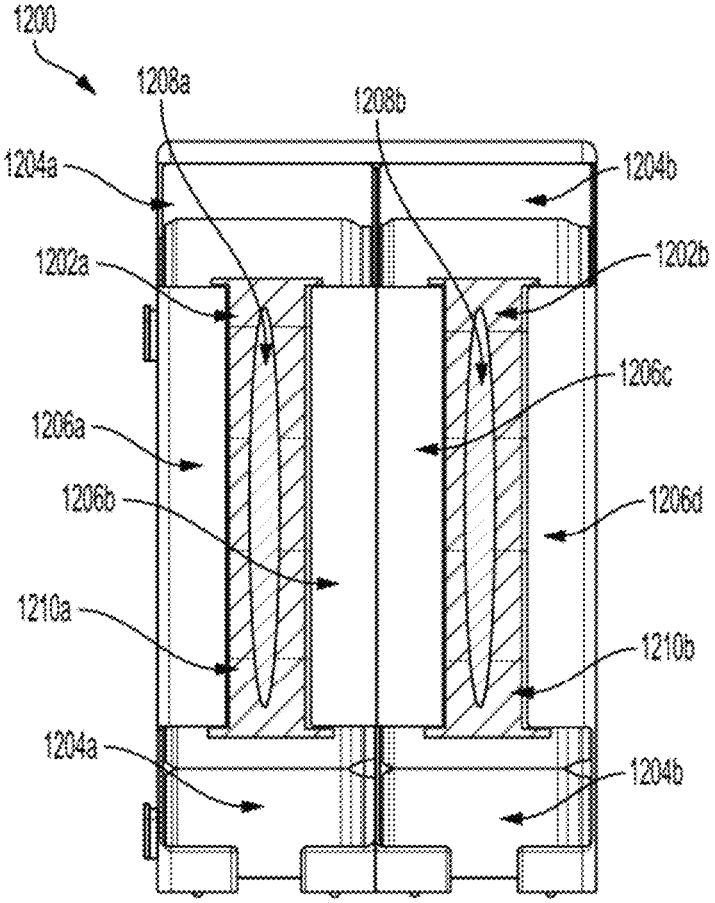
FIG. 12 depicts another example of a can rack system with front covers according to some embodiments of the present disclosure.

FIG. 12 depicts another example of a can rack system 1200 with front covers 1202*a-b* according to some embodiments of the present disclosure. The front covers 1202*a-b* can be removably coupled to front flaps 1206*a-d* of the can rack system 1200. For example, a first front cover 1202*a* can be positioned between a first front flap 1206*a* and a second front flap 1206*b*. Additionally, a second front cover 1202*b* can be positioned between a third front flap 1206*c* and a fourth front flap 1206*d*. The front covers 1202*a-b* may be removably coupled with the front flaps 1206*a-b* via snaps or another suitable mechanism. The front covers 1202*a-b* can be a similar length as the front flaps 1206*a-d*. In this way, the first front cover 1202*a* can cover a first front gap 1210*a* between front flaps 1206*a-b* and the second front cover 1202*b* can cover a second front gap 1210*b* between the front flaps 1206*c-d*. The front covers 1202*a-b* may not cover front openings 1204*a-d* to enable insertion and removal of cans from the can rack system 1200. Additionally, the front covers 1202*a-b* can have slots 1208*a-b* through which a user can reach to adjust cans in the can rack system 1200.

Figure 13:
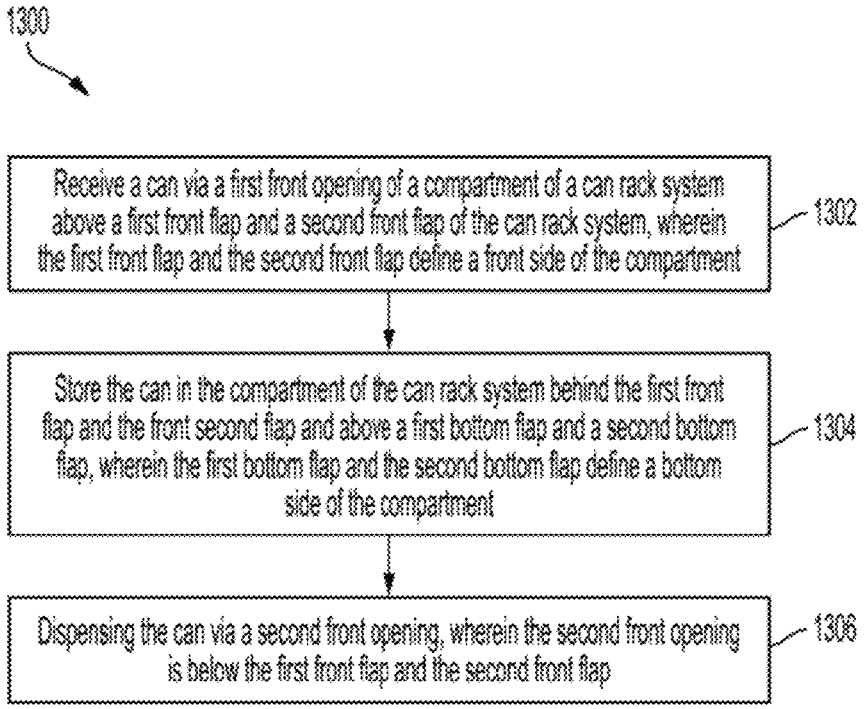
FIG. 13 is a flowchart of process for using openings of the can rack system according to one example of the present disclosure.

FIG. 13 is a flowchart of process 1300 for using openings of the can rack system according to one example of the present disclosure. While FIG. 13 depicts a certain sequence of steps for illustrative purposes, other examples can involve more steps, fewer steps, different steps, or a different order of the steps depicted in FIG. 13. The steps of FIG. 13 are described below with reference to the components of FIGS. 1-12 described above.

At block 1302, the process 1300 can involve receiving a can via a first front opening 304*a* of a compartment 301*a* of a can rack system 300 above a first front flap 306*a* and a second front flap 306*b* of the can rack system 300. The first front flap 306*a* and the second front flap 306*b* can define a front side of the compartment 301*a*. The first front flap 306*a* and the second front flap 306*b* can be shorter in length than a height of the compartment 301*a* to enable there to be the first front opening 304*a* above first front flap 306*a* and the second front flap 306*b*. Additionally, the first front opening 304*a* can be rectangular and can be dimensioned based on a type of can intended to be received by the can rack system 300. For example, the type of can may be a standard size soda can, a mini soda can, or another suitable type of can.

At block 1304, the process 1300 can involve, storing the can in the compartment 301*a* of the can rack system 300 behind the first front flap 306*a* and the second front flap 306*b*. The can may further be stored above or on top of a first bottom flap 312*a* and a second bottom flap 312*b*, which can define a bottom side of the compartment 301*a*. Additionally, the can may be stored in front of a first horizontal back support 406*a*, a second horizontal back support 406*b*, a first vertical back support 414*a*, or a combination thereof. The first horizontal back support 406*a*, the second horizontal back support 406*b*, and the vertical back support 414*a* can define a back side of the compartment 301*a*. The can may be stored in the compartment 301 subsequent to receiving the can.

At block 1306, the process 1300 can involve dispensing the can via a second front opening 304*b* below the first front flap 306*a* and the second front flap 306*b*. The second front opening 304*b* can also be rectangular and can be dimensioned based on the type of can intended to be received by and stored in the can rack system 300.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A can rack system for a refrigeration appliance, the can rack system comprising:

a compartment configured to store a plurality of cans;

a first horizontal back support;

a second horizontal back support;

a vertical back support defining a back side of the compartment, wherein a top edge of the vertical back support is coupled with the first horizontal back support and a bottom edge of the vertical back support is coupled with the second horizontal back support, and wherein the vertical back support comprises a plurality of back slots that are each configured to removably couple a back bumper of a plurality of back bumpers to the can rack system;

a top cover defining a top side of the compartment and coupled with at least two walls of the compartment, an edge of the top cover defining a top cut out in the top side of the compartment, the top cut out being configured to fit around an ice maker of the refrigeration appliance;

a first front flap defining a first portion of a front side of the compartment;

a second front flap defining a second portion of the front side of the compartment, wherein the first front flap is positioned parallel to and a first distance from the second front flap to produce a front gap in the front side of the compartment;

a first bottom flap defining a first portion of a bottom side of the compartment; and a second bottom flap defining a second portion of the bottom side of the compartment, wherein the first bottom flap is positioned parallel to and a second distance from the second bottom flap to produce a bottom gap in the bottom side of the compartment.

2. The can rack system of claim 1, wherein the first front flap and the second front flap have a length that is less than a height of the compartment, and wherein the first front flap and the second front flap are positioned to create a first front opening in the front side above the first front flap and the second front flap and to produce a second front opening in the front side below the first front flap and the second front flap.

3. The can rack system of claim 2, wherein a first width of the first front opening and of the second front opening is 125 millimeters (mm), wherein a first height of the first front opening is 73 mm, wherein a second height of the second front opening is 72 mm, wherein the first distance is 50 mm, and wherein the second distance is 37 mm.

4. The can rack system of claim 1, wherein the compartment is a first compartment, the bottom gap is a first bottom gap, the front gap is a first front gap, and the plurality of cans is a first plurality of cans, and wherein the can rack system further comprises:

a second compartment configured to store a second plurality of cans, wherein the second compartment is positioned adjacent to the first compartment;

a third front flap defining a first portion of a front side of the second compartment;

a fourth front flap defining a second portion of the front side of the second compartment, wherein the third front flap is positioned parallel to and the first distance from the fourth front flap to produce a second front gap in the front side of the second compartment;

a third bottom flap defining a first portion of a bottom side of the second compartment; and a fourth bottom flap defining a second portion of the bottom side of the second compartment, wherein the third bottom flap is positioned parallel to and the second distance from the fourth bottom flap to produce a second bottom gap in the bottom side of the second compartment.

5. The can rack system of claim 1, wherein the first horizontal back support has a height of 21 mm, and wherein the vertical back support has a width of 41 mm.

6. The can rack system of claim 1, further comprising a back opening above the first horizontal back support, wherein the top cut out and the back opening are configured to fit around the icemaker of the refrigeration appliance, and wherein the back opening has a height of 57 mm.

7. A refrigeration appliance comprising:

a can rack system, the can rack system comprising:

a compartment configured to store a plurality of cans;

a first horizontal back support;

a second horizontal back support;

a vertical back support defining a back side of the compartment, wherein a top edge of the vertical back support is coupled with the first horizontal back support and a bottom edge of the vertical back support is coupled with the second horizontal back support, and wherein the vertical back support comprises a plurality of back slots that are each configured to removably couple a back bumper of a plurality of back bumpers to the can rack system;

a top cover defining a top side of the compartment and coupled with at least two side walls of the compartment, an edge of the top cover defining a top cut out in the top side of the compartment, the top cut out being configured to fit around an ice maker of the refrigeration appliance;

a first front flap defining a first portion of a front side of the compartment;

a second front flap defining a second portion of the front side of the compartment, wherein the first front flap is positioned parallel to and a first distance from the second front flap to produce a front gap in the front side of the compartment;

a first bottom flap defining a first portion of a bottom side of the compartment; and a second bottom flap defining a second portion of the bottom side of the compartment, wherein the first bottom flap is positioned parallel to and a second distance from the second bottom flap to produce a bottom gap in the bottom side of the compartment.

8. The refrigeration appliance of claim 7, wherein the first front flap and the second front flap have a length that is less than a height of the compartment, and wherein the first front flap and the second front flap are positioned to create a first front opening in the front side above the first front flap and the second front flap and to produce a second front opening in the front side below the first front flap and the second front flap.

9. The refrigeration appliance of claim 8, wherein a first width of the first front opening and of the second front opening is 125 mm, wherein a first height of the first front opening is 73 mm, wherein a second height of the second front opening is 72 mm, wherein the first distance is 50 mm, and wherein the second distance is 37 mm.

10. The refrigeration appliance of claim 7, wherein the compartment is a first compartment, the bottom gap is a first bottom gap, the front gap is a first front gap, and the plurality of cans is a first plurality of cans, and wherein the can rack system further comprises:

a second compartment configured to store a second plurality of cans, wherein the second compartment is positioned adjacent to the first compartment;

a third front flap defining a first portion of a front side of the second compartment;

a fourth front flap defining a second portion of the front side of the second compartment, wherein the third front flap is positioned parallel to and the first distance from the fourth front flap to produce a second front gap in the front side of the second compartment;

a third bottom flap defining a first portion of a bottom side of the second compartment; and a fourth bottom flap defining a second portion of the bottom side of the second compartment, wherein the third bottom flap is positioned parallel to and the second distance from the fourth bottom flap to produce a second bottom gap in the bottom side of the second compartment.

11. The refrigeration appliance of claim 7, wherein the first horizontal back support has a height of 21 mm, and wherein the vertical back support has a width of 41 mm.

12. The refrigeration appliance of claim 7, wherein the can rack system further comprises a back opening above the first horizontal back support, wherein the top cut out and the back opening are configured to fit around the icemaker of the refrigeration appliance, and wherein the back opening has a height of 57 mm.

13. A method comprising:

receiving a can via a first front opening of a compartment of a can rack system of a refrigeration appliance, the first front opening being below a top cover of the can rack system and above a first front flap and a second front flap of the can rack system, wherein the top cover defines a top side of the compartment, an edge of the top cover defines a top cut out in the top side of the compartment, and the top cut out is configured to fit around an ice maker of the refrigeration appliance, wherein the first front flap and the second front flap define a front side of the compartment, and wherein the first front flap is positioned parallel to and a first distance from the second front flap to produce a front gap in the compartment;

subsequent to receiving the can, storing the can in the compartment of the can rack system behind the first front flap and the front second flap, above a first bottom flap and a second bottom flap, and in front of a first horizontal back support, a second horizontal back support, and vertical back support, wherein the first bottom flap and the second bottom flap define a bottom side of the compartment, and wherein the first bottom flap is positioned parallel to and a second distance from the second bottom flap to produce a bottom gap in the compartment, wherein a top edge of the vertical back support is connected to the first horizontal back support, wherein a bottom edge of the vertical back support is connected to the second horizontal back support, and wherein the vertical back support comprises a plurality of back slots that are each configured to removably couple a back bumper of a plurality of back bumpers to the can rack system; and dispensing the can via a second front opening, wherein the second front opening is below the first front flap and the second front flap.

14. The method of claim 13, wherein the first front flap and the second front flap have a first length that is less than a height of the compartment, and wherein the first front flap and the second front flap are positioned to create the first front opening in the compartment above the first front flap and the front second flap and to produce the second front opening in the compartment below the first front flap and the second front flap.

15. The method of claim 13, wherein a first width of the first front opening and of the second front opening is 125 mm, wherein a first height of first front opening is 73 mm, wherein a second height of the second front opening is 72 mm, wherein the first distance is 50 mm, and wherein the second distance is 37 mm.

* * * * *